US010909939B2

(12) United States Patent
Kim et al.

(10) Patent No.: US 10,909,939 B2
(45) Date of Patent: Feb. 2, 2021

(54) DISPLAY DEVICE INCLUDING DATA LINE ALTERNATELY CONNECTED TO ADJACENT PIXEL COLUMNS

(71) Applicant: Samsung Display Co., Ltd., Yongin-Si (KR)

(72) Inventors: Kwi Hyun Kim, Seongnam-si (KR); Kook Hyun Choi, Asan-si (KR); Kyungwon Park, Seoul (KR); Hyeong Jun Jin, Seoul (KR); Chang-Yong Hong, Cheonan-si (KR)

(73) Assignee: SAMSUNG DISPLAY CO., LTD., Gyeonggi-do (KR)

( * ) Notice: Subject to any disclaimer, the term of this patent is extended or adjusted under 35 U.S.C. 154(b) by 0 days.

(21) Appl. No.: 16/585,536

(22) Filed: Sep. 27, 2019

(65) Prior Publication Data

US 2020/0105212 A1 Apr. 2, 2020

(30) Foreign Application Priority Data

Oct. 1, 2018 (KR) ..... 10-2018-0116839

(51) Int. Cl.
*G09G 3/36* (2006.01)

(52) U.S. Cl.
CPC ..... *G09G 3/3614* (2013.01); *G09G 3/3607* (2013.01); *G09G 3/3688* (2013.01); *G09G 2320/0242* (2013.01)

(58) Field of Classification Search
None
See application file for complete search history.

(56) References Cited

U.S. PATENT DOCUMENTS

2012/0154259 A1* 6/2012 Kim ..... G09G 3/3291 307/108
2015/0213772 A1* 7/2015 Tung ..... G09G 3/3659 345/694

FOREIGN PATENT DOCUMENTS

| | | | |
|---|---|---|---|
| KR | 100223905 | B1 | 7/1999 |
| KR | 100236333 | B1 | 9/1999 |
| KR | 100264772 | B1 | 9/2000 |
| KR | 100467517 | B1 | 1/2005 |
| KR | 100476598 | B1 | 3/2005 |
| KR | 100870006 | B1 | 11/2008 |
| KR | 101243811 | B1 | 3/2013 |

* cited by examiner

*Primary Examiner* — Christopher J Kohlman
(74) *Attorney, Agent, or Firm* — Cantor Colburn LLP

(57) ABSTRACT

A display device includes a display panel including first color pixels in a first pixel column, second color pixels in a second pixel column, third color pixels in a third pixel column, a first data line connected to the second color pixels in first through N-th pixel rows and connected to the first color pixels in (N+1)-th through 2N-th pixel rows, and a second data line connected to the third color pixels in the first through N-th pixel rows and connected to the second color pixels in the (N+1)-th through 2N-th pixel rows, where N is an integer greater than 1, and a data driver which applies a first polarity data voltage to the first data line, and applies a second polarity data voltage to the second data line.

18 Claims, 14 Drawing Sheets

DISPLAY DEVICE INCLUDING DATA LINE ALTERNATELY CONNECTED TO ADJACENT PIXEL COLUMNS

This application claims priority to Korean Patent Application No. 10-2018-0116839, filed on Oct. 1, 2018, and all the benefits accruing therefrom under 35 U.S.C. § 119, the content of which in its entirety is herein incorporated by reference.

BACKGROUND

1. Field

Exemplary embodiments relate generally to display devices. More particularly, exemplary embodiments relate to display devices including a data line alternately connected to adjacent pixel columns.

2. Description of the Related Art

In a display device, such as a liquid crystal display ("LCD") device, to prevent deterioration of a liquid crystal due to continuous application of a data voltage of the same polarity between a pixel electrode and a common electrode, different driving methods are employed to periodically reverse the polarity of the data voltage. These driving methods used may include an inversion driving method, such as a frame inversion driving method, a line inversion driving method, a column inversion driving method, a dot inversion driving method, or the like to periodically reverse the polarity of the data voltage. The frame inversion driving method may reverse the polarity of the data voltage on a frame basis, the line inversion driving method may reverse the polarity of the data voltage on a pixel row basis, the column inversion driving method may reverse the polarity of the data voltage on a pixel column basis, and the dot inversion driving method may reverse the polarity of the data voltage on a pixel basis, for example.

Compared with the frame, line and column inversion driving methods, the dot inversion driving method may be more efficient to reduce crosstalk, or the like. However, the dot inversion driving method may have disadvantages in that power consumption is too large compared with those of the frame, line and column inversion driving methods. Recently, to reduce the power consumption while improving a display quality, a display device having an N-dot alternating structure where each data line is connected to a left pixel column or a right pixel column alternately per N pixel rows has been developed, where N is an integer greater than 1. In the display device having the N-dot alternating structure, although the data voltage of the same polarity is applied to each data line as in the column inversion driving method, the polarity of the data voltage may be reversed per N pixels (or N dots). Accordingly, in the display device having the N-dot alternating structure, the power consumption may be reduced while the display quality is improved.

SUMMARY

When a particular pattern image, such as a single color image, is displayed in a display device having a N-dot alternating structure, with respect to consecutive N pixel rows where each data line is connected to the same pixel column, a transition time during which a data voltage reaches to a desired voltage level in a first pixel row in which a pixel column to which the data line is connected is changed among the N pixel rows may be longer than transition times in the remaining N−1 pixel rows among the N pixel rows. Accordingly, a charging rate of a pixel in the first pixel row among the N pixel rows may be reduced compared with a charging rate of a pixel in the remaining N−1 pixel rows among the N pixel rows, and thus a horizontal line defect may occur.

Some exemplary embodiments provide a display device having an N-dot alternating structure capable of preventing a horizontal line defect.

According to some exemplary embodiments, there is provided a display device including a display panel including first color pixels in a first pixel column, second color pixels in a second pixel column adjacent to the first pixel column, third color pixels in a third pixel column adjacent to the second pixel column, a first data line connected to the second color pixels in first through N-th pixel rows and connected to the first color pixels in (N+1)-th through 2N-th pixel rows, and a second data line connected to the third color pixels in the first through N-th pixel rows and connected to the second color pixels in the (N+1)-th through 2N-th pixel rows, where N is an integer greater than 1, and a data driver which applies a first polarity data voltage to the first data line, and applies a second polarity data voltage to the second data line. When a single color image having a color of the second color pixels is displayed in at least a portion of the display panel corresponding to the first through third pixel columns and the first through 2N-th pixel rows, the data driver applies the first polarity data voltage to which a first emphasis voltage is added to the first data line in the first pixel row, and applies the second polarity data voltage to which a second emphasis voltage is added to the second data line in the (N+1)-th pixel row.

In an exemplary embodiment, when the single color image having the color of the second color pixels is displayed in at least the portion of the display panel, the data driver may apply the first polarity data voltage to which the first emphasis voltage is not added to the first data line in the second through N-th pixel rows, and may apply the second polarity data voltage to which the second emphasis voltage is not added to the second data line in the (N+2)-th through 2N-th pixel rows.

In an exemplary embodiment, when the single color image having the color of the second color pixels is displayed in at least the portion of the display panel, the data driver may apply, as the second polarity data voltage, a second polarity black data voltage to the second data line in the first through N-th pixel rows, and may apply, as the first polarity data voltage, a first polarity black data voltage to the first data line in the (N+1)-th through 2N-th pixel rows.

In an exemplary embodiment, in a first frame, the first polarity data voltage may be a positive data voltage, the second polarity data voltage may be a negative data voltage, the first emphasis voltage may be a positive emphasis voltage, and the second emphasis voltage may be a negative emphasis voltage. In a second frame subsequent to the first frame, the first polarity data voltage may be the negative data voltage, the second polarity data voltage may be the positive data voltage, the first emphasis voltage may be the negative emphasis voltage, and the second emphasis voltage may be the positive emphasis voltage.

In an exemplary embodiment, when the single color image having a color of the first color pixels is displayed in at least the portion of the display panel, the data driver may apply the first polarity data voltage to which the first emphasis voltage is added to the first data line in the (N+1)-th pixel row.

In an exemplary embodiment, when the single color image having a color of the third color pixels is displayed in at least the portion of the display panel, the data driver may apply the second polarity data voltage to which the second emphasis voltage is added to the second data line in the first pixel row.

In an exemplary embodiment, when a mixed color image having a color of the first color pixels and the color of the second color pixels is displayed in at least the portion of the display panel, the data driver may apply the second polarity data voltage to which the second emphasis voltage is added to the second data line in the (N+1)-th pixel row.

In an exemplary embodiment, when a mixed color image having a color of the first color pixels and a color of the third color pixels is displayed in at least the portion of the display panel, the data driver may apply the second polarity data voltage to which the second emphasis voltage is added to the second data line in the first pixel row, and may apply the first polarity data voltage to which the first emphasis voltage is added to the first data line in the (N+1)-th pixel row.

In an exemplary embodiment, when a mixed color image having the color of the second color pixels and a color of the third color pixels is displayed in at least the portion of the display panel, the data driver may apply the first polarity data voltage to which the first emphasis voltage is added to the first data line in the first pixel row.

In an exemplary embodiment, the display device may further include a controller which receives input image data, and generates compensated image data by increasing a portion of the input image data for the first pixel row and the (N+1)-th pixel row where a pixel column to which each of the first and second data lines is connected is changed by a gray level increment corresponding to the first emphasis voltage or the second emphasis voltage when the input image data represent the single color image having one color of three colors of the first through third color pixels or a mixed color image having two colors of the three colors of the first through third color pixels.

In an exemplary embodiment, the controller may include an image determiner which determines whether the input image data represent the single color image or the mixed color image, and a data compensator which increases the input image data for a current pixel row and a current pixel column by the gray level increment when the input image data represent the single color image or the mixed color image, the current pixel column to which each of the first and second data lines is connected in the current pixel row is different from a previous pixel column to which each of the first and second data lines is connected in a previous pixel row, the input image data for the previous pixel column represent a gray level of 0, and the input image data for the current pixel column represent a gray level other than 0.

In an exemplary embodiment, when the input image data for the first color pixels represent the gray level of 0 and the input image data for the second color pixels represent the gray level other than 0, the data compensator may increase the input image data for the second color pixels in the first pixel row and the second pixel column by the gray level increment. When the input image data for the first color pixels represent the gray level other than 0 and the input image data for the second color pixels represent the gray level of 0, the data compensator may increase the input image data for the first color pixels in the (N+1)-th pixel row and the first pixel column by the gray level increment. When the input image data for the second color pixels represent the gray level of 0 and the input image data for the third color pixels represent the gray level other than 0, the data compensator may increase the input image data for the third color pixels in the first pixel row and the third pixel column by the gray level increment. When the input image data for the second color pixels represent the gray level other than 0 and the input image data for the third color pixels represent the gray level of 0, the data compensator may increase the input image data for the second color pixels in the (N+1)-th pixel row and the second pixel column by the gray level increment.

In an exemplary embodiment, the gray level increment may be determined based on at least one of a position of a pixel to which the first emphasis voltage or the second emphasis voltage is applied and a gray level of the input image data for the pixel to which the first emphasis voltage or the second emphasis voltage is applied.

In an exemplary embodiment, the gray level increment may increase as a distance from the data driver to the pixel to which the first emphasis voltage or the second emphasis voltage is applied increases.

In an exemplary embodiment, the gray level increment may be determined such that a ratio of the gray level increment to the gray level of the input image data decreases as the gray level of the input image data increases.

According to some exemplary embodiment, there is provided a display device including a display panel including a plurality of pixels arranged in a matrix having a plurality of pixel rows and a plurality of pixel columns, and a plurality of data lines extending in a direction of the plurality of pixel columns, and a data driver which alternately provides a positive data voltage or a negative data voltage to the plurality of data lines. Each data line of the plurality of data lines is disposed between two adjacent pixel columns of the plurality of pixel columns, and is connected to one or a remaining one of the two adjacent pixel columns alternately per N pixel rows of the plurality of pixel rows, where N is an integer greater than 1. When a current pixel column to which the each data line is connected in a current pixel row is different from a previous pixel column to which the each data line is connected in a previous pixel row, and input image data for a current pixel in the current pixel row and the current pixel column is greater, by more than a predetermined gray level difference, than the input image data for a previous pixel in the previous pixel row and the previous pixel column, the data driver applies the positive data voltage to which a positive emphasis voltage is added or the negative data voltage to which a negative emphasis voltage is added to the current pixel.

In an exemplary embodiment, the display device may further include a controller which receives the input image data, compares the input image data for the current pixel with the input image data for the previous pixel in the current pixel row where the current pixel column to which the each data line is connected is different from the previous pixel column to which the each data line is connected in the previous pixel row, and generates compensated image data by increasing the input image data for the current pixel by a gray level increment corresponding to the positive emphasis voltage or the negative emphasis voltage when the input image data for the current pixel is greater, by more than the predetermined gray level difference, than the input image data for the previous pixel.

In an exemplary embodiment, the controller may include a gray level difference calculator which calculates a gray level difference by subtracting a gray level of the input image data for the previous pixel from a gray level of the input image data for the current pixel in the current pixel row where the current pixel column to which the each data line is connected is different from the previous pixel column to which the each data line is connected in the previous pixel row, and a data compensator which increases the input image data for the current pixel by the gray level increment when a calculated gray level difference is greater than the predetermined gray level difference.

In an exemplary embodiment, the gray level increment may be determined based on at least one of a position of the current pixel, a gray level of the input image data for the current pixel, and a gray level difference between the input image data for the current pixel and the input image data for the previous pixel.

In an exemplary embodiment, the gray level increment may increase as a distance from the data driver to the current pixel increases.

As described above, the display device according to exemplary embodiments may have an N-dot alternating structure where each of a plurality of data lines is connected to one or the other of two adjacent pixel columns alternately per N pixel rows, where N is an integer greater than 1, and may alternately provide a positive data voltage or a negative data voltage to the plurality of data lines, thereby performing an N-dot inversion method while reducing power consumption.

Further, when a single/mixed color image where at least one of first through third colors (e.g., a red color, a green color and a blue color) does not exist is displayed, or when, with respect to each data line, a gray level in a current pixel row is greater, by more than a predetermined gray level difference, than a gray level in a previous pixel row, the display device according to exemplary embodiments may apply a data voltage to which an emphasis voltage is added in a first pixel row among the N pixel rows, thereby preventing a horizontal line defect.

BRIEF DESCRIPTION OF THE DRAWINGS

Illustrative, non-limiting exemplary embodiments will be more clearly understood from the following detailed description taken in conjunction with the accompanying drawings.

DETAILED DESCRIPTION

Figure 1:
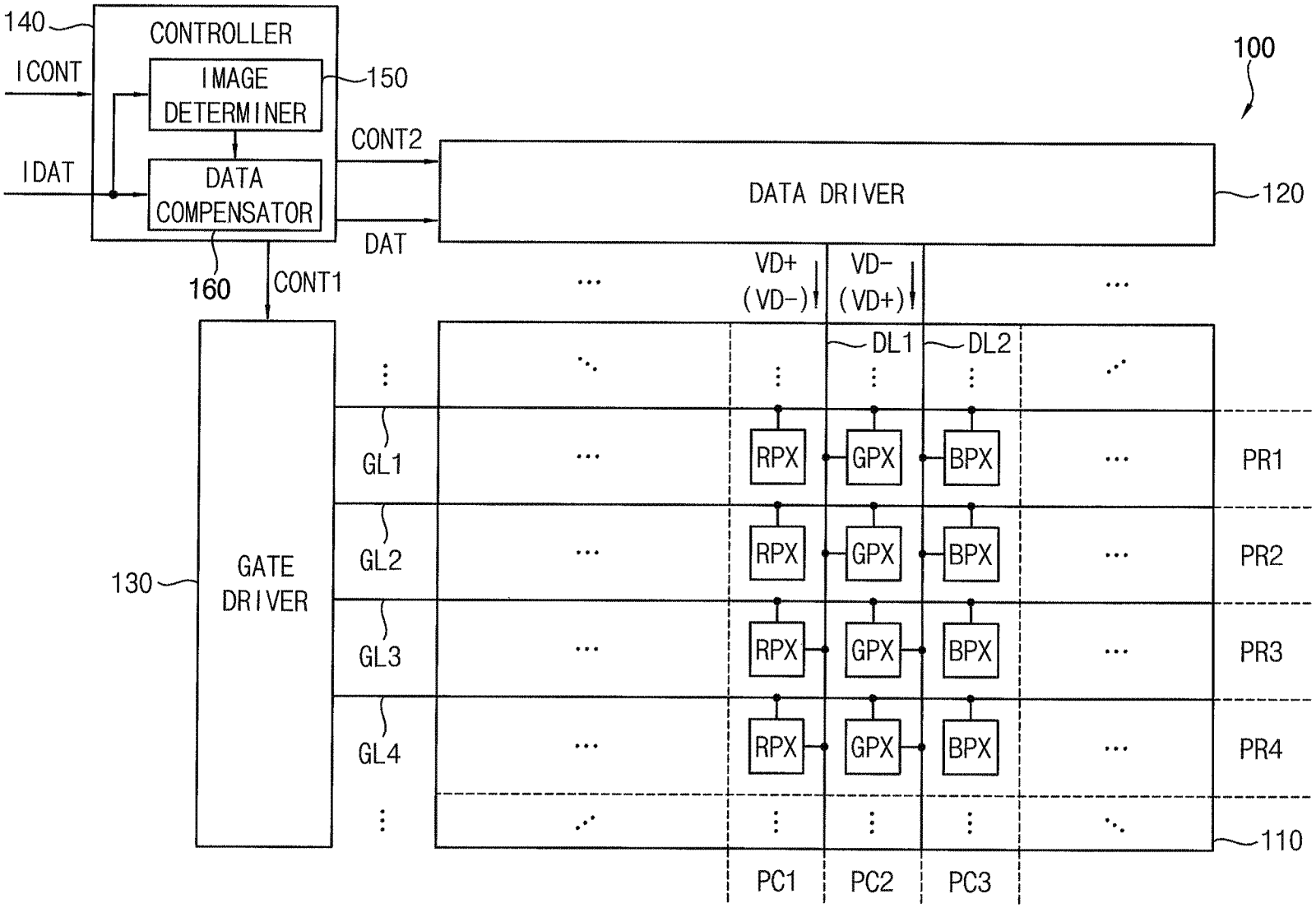
FIG. 1 is a block diagram illustrating an exemplary embodiment of a display device.

The exemplary embodiments are described more fully hereinafter with reference to the accompanying drawings. Like or similar reference numerals refer to like or similar elements throughout.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein should be interpreted accordingly.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Figure 2:
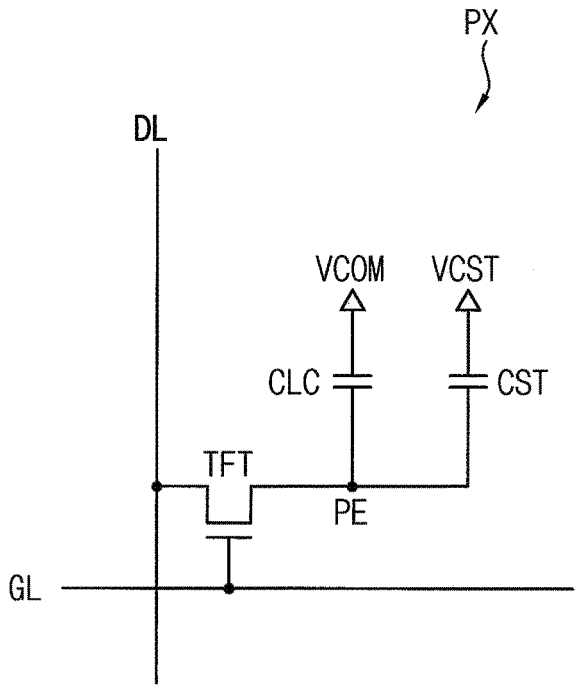
FIG. 2 is a diagram illustrating an example of a pixel included in a display device of FIG. 1.
Figure 3:
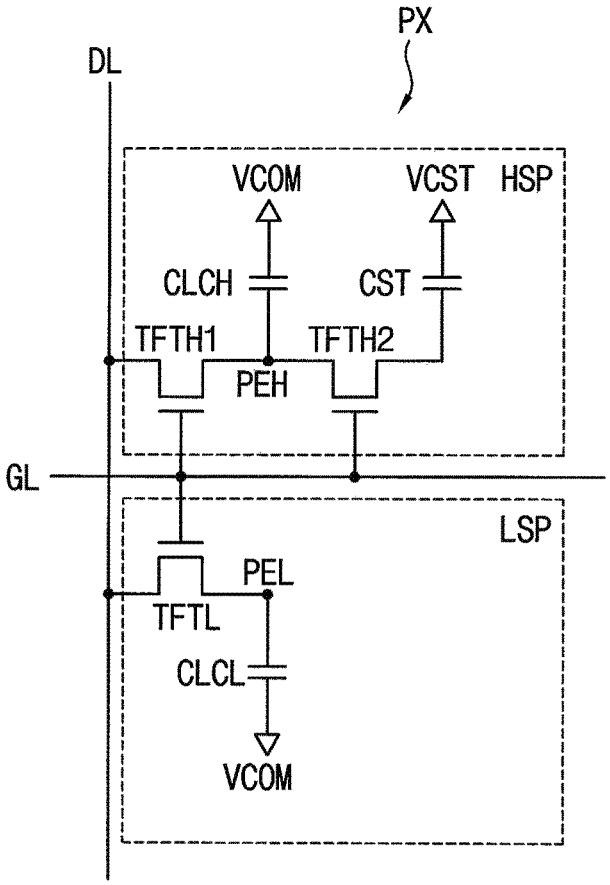
FIG. 3 is a diagram illustrating another example of a pixel included in a display device of FIG. 1.
Figure 4:
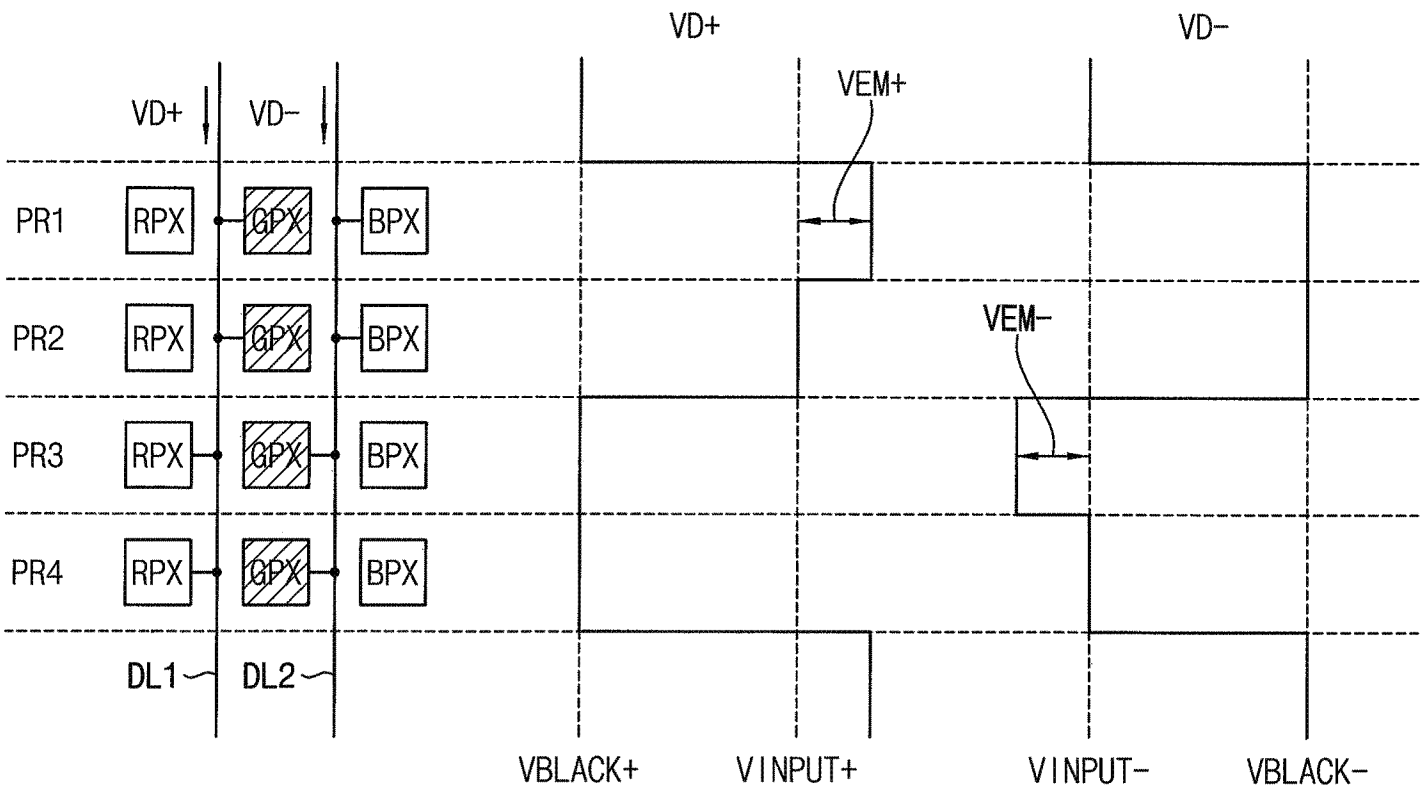
FIG. 4 is a diagram for describing data voltages applied to first and second data lines when a green single color image is displayed in at least a portion of a display panel.
Figure 5:
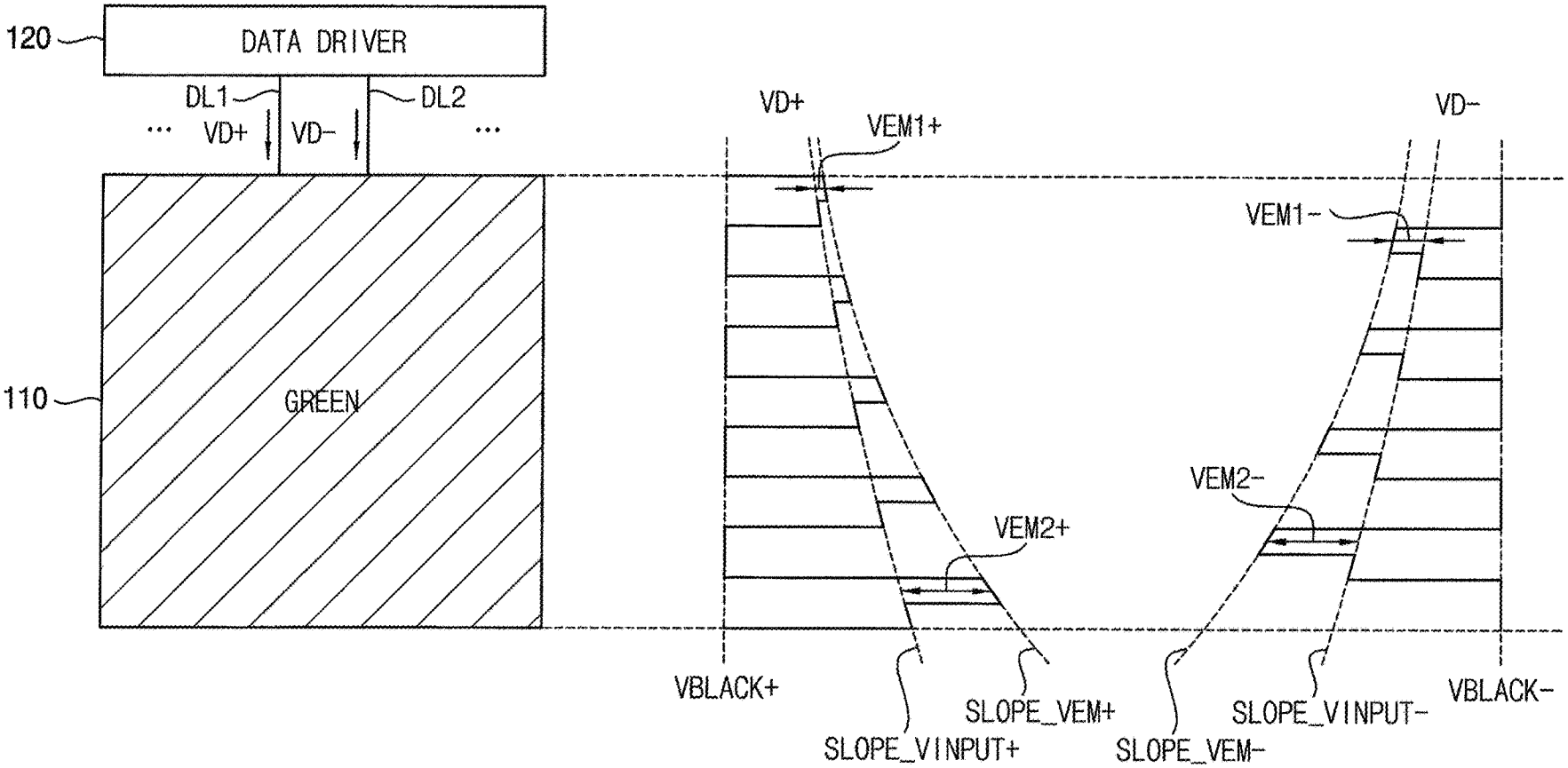
FIG. 5 is a diagram for describing an exemplary embodiment of emphasis voltages added to data voltages when a green single color image is displayed by a display device.

FIG. 1 is a block diagram illustrating an exemplary embodiment of a display device, FIG. 2 is a diagram illustrating an example of a pixel included in a display device of FIG. 1, FIG. 3 is a diagram illustrating another example of a pixel included in a display device of FIG. 1, FIG. 4 is a diagram for describing data voltages applied to first and second data lines when a green single color image is displayed in at least a portion of a display panel, and FIG. 5 is a diagram for describing an exemplary embodiment of emphasis voltages added to data voltages when a green single color image is displayed by a display device.

Referring to FIG. 1, a display device 100 may include a display panel 110, a data driver 120, a gate driver 130 and a controller 140.

The display panel 110 may include a plurality of data lines DL1 and DL2 extending in a direction of pixel columns PC1 through PC3, a plurality of gate lines GL1 through GL4 extending in a direction of pixel rows PR1 through PR4, and a plurality of pixels RPX, GPX and BPX connected to the plurality of data lines DL1 and DL2 and the plurality of gate lines GL1 through GL4. In some exemplary embodiments, the display panel 110 may be a liquid crystal display ("LCD") panel, for example. However, the display panel 110 may not be limited to the LCD panel, and may be any display panel. The plurality of pixels RPX, GPX and BPX may be arranged in a matrix having a plurality of pixel rows PR1 through PR4 and a plurality of pixel columns PC1 through PC3. In some exemplary embodiments, as illustrated in FIG. 1, the display panel 110 may have a RGB stripe structure where first color pixels (e.g., red pixels) RPX are disposed in a first pixel column PC1, second color pixels (e.g., green pixels) GPX are disposed in a second pixel column PC2 adjacent to the first pixel column PC1, and third color pixels (e.g., blue pixels) BPX are disposed in a third pixel column PC3 adjacent to the second pixel column PC2. In some exemplary embodiments, the first, second and third color pixels RPX, GPX and BPX may have the substantially the same pixel structure, except that different color filters are disposed on the same pixel structure.

In some exemplary embodiments, as illustrated in FIG. 2, each pixel PX may include a pixel electrode PE, a switching element TFT that transfers a data voltage to the pixel electrode PE, a liquid crystal capacitor CLC disposed between the pixel electrode PE and a common electrode to which a common voltage VCOM is applied, and a storage capacitor CST disposed between the pixel electrode PE and a storage electrode to which a storage voltage VCST is applied. The switching element TFT may include a gate terminal connected to a gate line GL, a first terminal connected to a data line DL, and a second terminal connected to the pixel electrode PE.

In other exemplary embodiments, as illustrated in FIG. 3, each pixel PX may include a high sub-pixel HSP and a low sub-pixel LSP. The high sub-pixel HSP may include a first pixel electrode PEH, a first switching element TFTH1 that transfers a data voltage to the first pixel electrode PEH, a second switching element TFTH2 that transfers a storage voltage VCST to the first pixel electrode PEH, a first liquid crystal capacitor CLCH disposed between the first pixel electrode PEH and a common electrode to which a common voltage VCOM is applied, and a storage capacitor CST disposed between the second switching element TFTH2 and a storage electrode to which the storage voltage VCST is applied. The first switching element TFTH1 may include a gate terminal connected to a gate line GL, a first terminal connected to a data line DL, and a second terminal connected to the first pixel electrode PEH. The second switching element TFTH2 may include a gate terminal connected to the gate line GL, a first terminal connected to the storage capacitor CST, and a second terminal connected to the first pixel electrode PEH. The low sub-pixel LSP may include a second pixel electrode PEL, a third switching element TFTL that transfers the data voltage to the second pixel electrode PEL, and a second liquid crystal capacitor CLCL disposed between the second pixel electrode PEL and the common electrode. The third switching element TFTL may include a gate terminal connected to the gate line GL, a first terminal connected to the data line DL, and a second terminal connected to the second pixel electrode PEL. In some exemplary embodiments, a size of the high sub-pixel HSP may be equal to or smaller than a size of the low sub-pixel LSP. In other words, a size of the first pixel electrode PEH may be equal to or smaller than a size of the second pixel electrode PEL. In an exemplary embodiment, a ratio between the size of the high sub-pixel HSP and the size of the low sub-pixel LSP may be about 1:2, for example. Further, in some exemplary embodiments, a resistance of the first switching element TFTH1 may be less than a resistance of the second switching element TFTH2. In an exemplary embodiment, a width to length (W/L) ratio of a channel of the first switching element TFTH1 may be greater than a width to length (W/L) ratio of a channel of the second switching element TFTH2, for example.

Although FIGS. 2 and 3 illustrate an exemplary embodiment of pixels PX, the pixel structure of each of the first through third color pixels RPX, GPX and BPX included in the display device 100 may not be limited to the examples of FIGS. 2 and 3.

In the display device 100 according to exemplary embodiments, the display panel 110 may have an N-dot alternating structure where each data line (e.g., DL1) is connected to one or the other of two adjacent pixel columns (e.g., PC1 and PC2) alternately per N pixel (or dot) rows, where N is an integer greater than 1. In an exemplary embodiment, as illustrated in FIG. 1, a first data line DL1 disposed between the first pixel column PC1 and the second pixel column PC2 may be connected to the second color pixels GPX of the second pixel column PC2 in first and second pixel rows PR1 and PR2, and may be connected to the first color pixels RPX of the first pixel column PC1 in third and fourth pixel rows PR3 and PR4, for example. Further, a second data line DL2 disposed between the second pixel column PC2 and the third pixel column PC3 may be connected to the third color pixels BPX of the third pixel column PC3 in the first and second pixel rows PR1 and PR2, and may be connected to the second color pixels GPX of the second pixel column PC2 in the third and fourth pixel rows PR3 and PR4. Although FIG. 1 illustrates an example of a 2-dot alternating structure where each data line DL1 and DL2 is connected to one or the other of two adjacent pixel columns alternately per two pixel rows, the display device 100 according to exemplary embodiments may not be limited to the 2-dot alternating structure.

The data driver 120 may generate data voltages VD+ and VD− based on image data DAT and a data control signal CONT2 output from the controller 140, and may apply the data voltages VD+ and VD− to the plurality of data lines DL1 and DL2. In an exemplary embodiment, the data control signal CONT2 may include, but not limited to, a horizontal start signal, a polarity control signal and a data load signal, for example. In some exemplary embodiments, the data driver 120 may be implemented as one or more data integrated circuits ("ICs"). Further, in exemplary embodiments, the data driver (or ICs) 120 may be disposed (e.g., mounted) on the display panel 110, or may be connected to the display panel 110 in a chip on film ("COF") manner or a tape automated bonding ("TAB") manner. In other exemplary embodiments, the data driver 120 may be integrated on the display panel 110.

The gate driver 130 may generate gate signals based on a gate control signal CONT1 output from the controller 140, and may apply the gate signals to the plurality of gate lines GL1 through GL4. In an exemplary embodiment, the gate control signal CONT1 may include, but not limited to, a vertical start signal and a gate clock signal, for example. In some exemplary embodiments, the gate driver 130 may be implemented as one or more gate ICs. Further, in exemplary embodiments, the gate driver (or ICs) 130 may be disposed (e.g., mounted) on the display panel 110, or may be connected to the display panel 110 in the COF manner or the TAB manner. In other exemplary embodiments, the gate driver 130 may be integrated on the display panel 110.

The controller 140 may receive input image data IDAT and an input control signal ICONT from an external host (e.g., a graphic processing unit ("GPU") or a graphic card). In some exemplary embodiments, the input image data IDAT may be RGB data including red image data, green image data and blue image data, for example. However, the invention is not limited thereto, and the input image data IDAT may include various other color data. In some exemplary embodiments, the input control signal ICONT may include, but not limited to, a master clock signal, a data enable signal, a vertical synchronization signal and a horizontal synchronization signal. The controller 140 may generate the data control signal CONT2, the gate control signal CONT1 and the image data DAT based on the input image data IDAT and the input control signal ICONT. The controller 140 may control an operation of the data driver 120 by providing the data control signal CONT2 and the image data DAT to the data driver 120, and may control an operation of the gate driver 130 by providing the gate control signal CONT1 to the gate driver 130. In some exemplary embodiments, the controller 140 may be a timing controller ("TCON"), for example. Further, although it is not illustrated, the controller 140 may include components for image correction, mura correction, dynamic capacitance compensation ("DCC") and/or dithering, for example.

In the display device 100 according to exemplary embodiments, the data driver 120 may provide a first polarity data voltage (e.g., VD+) having a first polarity or a second polarity data voltage (e.g., VD−) having a second polarity opposite to the first polarity alternately to the plurality of data lines DL1 and DL2 as in a column inversion driving method. Further, the data driver 120 may alternately provide the first polarity data voltage (e.g., VD+) or the second polarity data voltage (e.g., VD−) to each data line DL1 and DL2 on a frame basis. In an exemplary embodiment, in a first frame, the data driver 120 may apply a positive data voltage VD+ to the first data line DL1, and may apply a negative data voltage VD− to the second data line DL2, for example. Further, in a second frame subsequent to the first frame, the data driver 120 may apply the negative data voltage VD− to the first data line DL1, and may apply the positive data voltage VD+ to the second data line DL2. As described above, although the same polarity data voltage is applied to each data line in one frame as in the column inversion driving method, since the display panel 110 has the N-dot alternating structure where each data line DL1 and DL2 is connected to one or the other of two adjacent pixel columns alternately per the N pixel (or dot) rows, the display device 100 according to exemplary embodiments may perform an N-dot inversion method while reducing power consumption.

When a particular pattern image, such as a single color image, is displayed in the display device 100 having the N-dot alternating structure, with respect to consecutive N pixel rows (e.g., PR3 and PR4) where each data line (e.g., DL1) is connected to the same pixel column (e.g., PC1), a transition time during which the data voltage VD+ and VD− reaches to a desired voltage level in a first pixel row PR3 among the N pixel rows PR3 and PR4 in which a pixel column PC1 to which the data line DL1 is connected is different from a pixel column PC2 to which the data line DL1 is connected in a directly previous pixel row PR2 may be longer than a transition time in the remaining N−1 pixel rows PR4 among the N pixel rows PR3 and PR4. Accordingly, a charging rate of a pixel RPX in the first pixel row PR3 among the N pixel rows PR3 and PR4 may be reduced compared with a charging rate of a pixel RPX in the remaining N−1 pixel rows PR4 among the N pixel rows PR3 and PR4, and thus a horizontal line defect may occur. However, to prevent this horizontal line defect, the display device 100 according to exemplary embodiments may apply the data voltage VD+ and VD− to which an emphasis voltage is added in the first pixel row (e.g., PR3) among the N pixel rows (e.g., PR3 and PR4) when a single/mixed color image where at least one of first through third colors (e.g., a red color, a green color and a blue color) does not exist is displayed.

In an exemplary embodiment, as illustrated in FIG. 4, when a single color image having the green color is displayed in at least a portion of the display panel 110 corresponding to first through third pixel columns PC1 through PC3 and first through fourth pixel rows PR1 through PR4, or when the input image data IDAT for the red pixels RPX in the first pixel column PC1 and the blue pixels BPX in the third pixel column PC3 represent a gray level of 0 and the input image data IDAT for the green pixels GPX in the second pixel column PC2 represent a gray level other than 0, the data driver 120 may apply the first polarity data voltage (e.g., VD+) to which a first emphasis voltage (e.g., VEM+) is added to the first data line DL1 in the first pixel row PR1, and may apply the second polarity data voltage (e.g., VD−) to which a second emphasis voltage (e.g., VEM−) is added to the second data line DL2 in the third pixel row PR3, for example. In an exemplary embodiment, in a first frame, as illustrated in FIG. 4, the first polarity data voltage may be the positive data voltage VD+, the second polarity data voltage may be the negative data voltage VD−, the first emphasis voltage may be a positive emphasis voltage VEM+, and the second emphasis voltage may be a negative emphasis voltage VEM−, for example. Here, the positive data voltage VD+ to which the positive emphasis voltage VEM+ is added may correspond to a sum of a positive data voltage VINPUT+ corresponding to the input image data IDAT and the positive emphasis voltage VEM+, and the negative data voltage VD− to which the negative emphasis voltage VEM− is added may correspond to a sum of a negative data voltage VINPUT− corresponding to the input image data IDAT and the negative emphasis voltage VEM−. Further, in a second frame subsequent to the first frame, the first polarity data voltage may be the negative data voltage VD−, the second polarity data voltage may be the positive data voltage VD+, the first emphasis voltage may be the negative emphasis voltage VEM−, and the second emphasis voltage may be the positive emphasis voltage VEM+.

Further, as illustrated in FIG. 4, when the single color image having the green color is displayed in at least the portion of the display panel 110, the data driver 120 may apply the first polarity data voltage (e.g., VD+) to which the first emphasis voltage (e.g., VEM+) is not added to the first data line DL1 in the second pixel row PR2, and may apply the second polarity data voltage (e.g., VD−) to which the second emphasis voltage (e.g., VEM−) is not added to the second data line DL2 in the fourth pixel row PR4. In an exemplary embodiment, the first polarity data voltage VD+ to which the first emphasis voltage VEM+ is not added may correspond to the positive data voltage VINPUT+ corresponding to the input image data IDAT, and the second polarity data voltage VD− to which the second emphasis voltage VEM− is not added may correspond to the negative data voltage VINPUT− corresponding to the input image data IDAT, for example. Further, the data driver 120 may apply, as the second polarity data voltage (e.g., VD−), a second polarity black data voltage (e.g., VBLACK−) to the second data line DL2 in the first and second pixel rows PR1 and PR2, and may apply, as the first polarity data voltage (e.g., VD+), a first polarity black data voltage (e.g., VBLACK+) to the first data line DL1 in the third and fourth pixel rows PR3 and PR4. The first polarity black data voltage (e.g., VBLACK+) and the second polarity black data voltage (e.g., VBLACK−) may be data voltages applied to the data lines DL1 and DL2 when the input image data IDAT represent the gray level of 0. In exemplary embodiments, the first polarity black data voltage (e.g., VBLACK+) and the second polarity black data voltage (e.g., VBLACK−) may be different voltages, or may be substantially the same voltage, for example the common voltage VCOM.

To apply the data voltage VD+ and VD− to which the emphasis voltage VEM+ and VEM− is added in the first pixel row PR1 and the third pixel row PR3 where a pixel column PC1, PC2 and PC3 to which each data line DL1 and DL2 is connected is changed when the single/mixed color image is displayed, the controller 140 may generate compensated image data DAT by increasing a portion of the input image data IDAT for the first pixel row PR1 and the third pixel row PR3 where the pixel column PC1, PC2 and PC3 to which each data line DL1 and DL2 is connected is changed by a gray level increment corresponding to the first emphasis voltage (e.g., VEM+) or the second emphasis voltage (e.g., VEM−) when the input image data IDAT represent the single color image having one color of three colors of the first through third color pixels RPX, GPX and BPX or the mixed color image having two colors of the three colors of the first through third color pixels RPX, GPX and BPX. To perform the aforementioned operation, the controller 140 may include an image determiner 150 and a data compensator 160.

The image determiner 150 may determine whether the input image data IDAT represent the single color image having only one color of the three colors or the mixed color image having only two colors of the three colors. In some exemplary embodiments, the image determiner 150 may determine whether the input image data IDAT represent the single/mixed color image on a frame basis. In other exemplary embodiments, the image determiner 150 may divide the display panel 110 into a plurality of pixel blocks, and may determine whether the input image data IDAT represent the single/mixed color image on a pixel block basis.

When it is determined that the input image data IDAT represent the single/mixed color image, the data compensator 160 may increase the input image data IDAT for a current pixel row (e.g., PR3) and a current pixel column (e.g., PC2) by the gray level increment when the current pixel column (e.g., PC2) to which each data line (e.g., DL2) is connected in the current pixel row (e.g., PR3) is different from a previous pixel column (e.g., PC3) to which each data line (e.g., DL2) is connected in a previous pixel row (e.g., PR2), the input image data IDAT for the previous pixel column (e.g., PC3) represent the gray level of 0, and the input image data IDAT for the current pixel column (e.g., PC2) represent the gray level other than 0.

In an exemplary embodiment, when the input image data IDAT for the red pixels RPX represent the gray level of 0 and the input image data IDAT for the green pixels GPX represent the gray level other than 0, the data compensator 160 may increase the input image data IDAT for the green pixels GPX in the first pixel row PR1 and the second pixel column PC2 by the gray level increment, for example. When the input image data IDAT for the red pixels RPX represent the gray level other than 0 and the input image data IDAT for the green pixels GPX represent the gray level of 0, the data compensator 160 may increase the input image data IDAT for the red pixels RPX in the third pixel row PR3 and the first pixel column PC1 by the gray level increment. When the input image data IDAT for the green pixels GPX represent the gray level of 0 and the input image data IDAT for the blue pixels BPX represent the gray level other than 0, the data compensator 160 may increase the input image data IDAT for the blue pixels BPX in the first pixel row PR1 and the third pixel column PC3 by the gray level increment. When the input image data IDAT for the green pixels GPX represent the gray level other than 0 and the input image data IDAT for the blue pixels BPX represent the gray level of 0, the data compensator 160 may increase the input image data IDAT for the green pixels GPX in the third pixel row PR3 and the second pixel column PC2 by the gray level increment.

The gray level increment corresponding to the first emphasis voltage (e.g., VEM+) or the second emphasis voltage (e.g., VEM−), or an absolute value of the first emphasis voltage (e.g., VEM+) or the second emphasis voltage (e.g., VEM−) may be determined based on at least one of a position of a pixel to which the first emphasis voltage (e.g., VEM+) or the second emphasis voltage (e.g., VEM−) is applied and a gray level of the input image data IDAT for the pixel to which the first emphasis voltage (e.g., VEM+) or the second emphasis voltage (e.g., VEM−) is applied.

In some exemplary embodiments, the gray level increment may increase as a distance from the data driver 120 to the pixel to which the first emphasis voltage (e.g., VEM+) or the second emphasis voltage (e.g., VEM−) is applied increases. In an exemplary embodiment, as represented by differences between emphasized voltage curves SLOPE_VEM+ and SLOPE_VEM− and input data voltage curves SLOPE_VINPUT+ and SLOPE_VINPUT− illustrated in FIG. 5, the emphasis voltage VEM1+, VEM2+, VEM1− and VEM2− may increase as the distance from the data driver 120 to the pixel increases, for example. In an exemplary embodiment, even when the input image data IDAT for a first pixel relatively close to the data driver 120 and the input image data IDAT for a second pixel relatively distant from the data driver 120 represent substantially the same gray level, the emphasis voltage VEM2+ and VEM2− applied to the second pixel may have an absolute value greater than that of the emphasis voltage VEM1+ and VEM1− applied to the first pixel, for example. Further, as represented by the input data voltage curves SLOPE_VINPUT+ and SLOPE_VINPUT− illustrated in FIG. 5, even when the input image data IDAT represent substantially the same gray level, an absolute value of the data voltage VINPUT+ and VINPUT− corresponding to the input image data IDAT may also increase as the distance from the data driver 120 to the pixel increases. Accordingly, even when the single color image or the mixed color image is displayed, all the pixels RPX, GPX and BPX may have substantially the same charging rate, thereby preventing the horizontal line defect.

Further, in some exemplary embodiments, the gray level increment may be determined such that a ratio of the gray level increment to the gray level of the input image data IDAT decreases as the gray level of the input image data IDAT increases. In an exemplary embodiment, with respect to a pixel to which the emphasis voltage VEM+ and VEM− is applied, the data compensator 160 may generate the compensated image data DAT representing a gray level of 35 by increasing the input image data IDAT by the gray level increment of 5 when the input image data IDAT represent a gray level of 30, and may generate the compensated image data DAT representing a gray level of 210 by increasing the input image data IDAT by the gray level increment of 10 when the input image data IDAT represent a gray level of 200, for example. Thus, in a case where the input image data IDAT are increased from the gray level of 30 to the gray level of 200, although the gray level increment is increased from the gray level increment of 5 to the gray level increment of 10, the ratio of the gray level increment to the gray level may be decreased, for example.

As described above, when the single/mixed color image where at least one of the three colors (e.g., the red color, the green color and the blue color) does not exist is displayed, the display device 100 according to exemplary embodiments may apply the data voltage VD+ and VD− to which the emphasis voltage VEM+ and VEM− is added to each data line DL1 and DL2 in a first pixel row (e.g., PR1) among consecutive N pixel rows (e.g., PR1 and PR2) where each data line DL1 and DL2 is connected to the same pixel column, thereby preventing the horizontal line defect.

Figure 6:
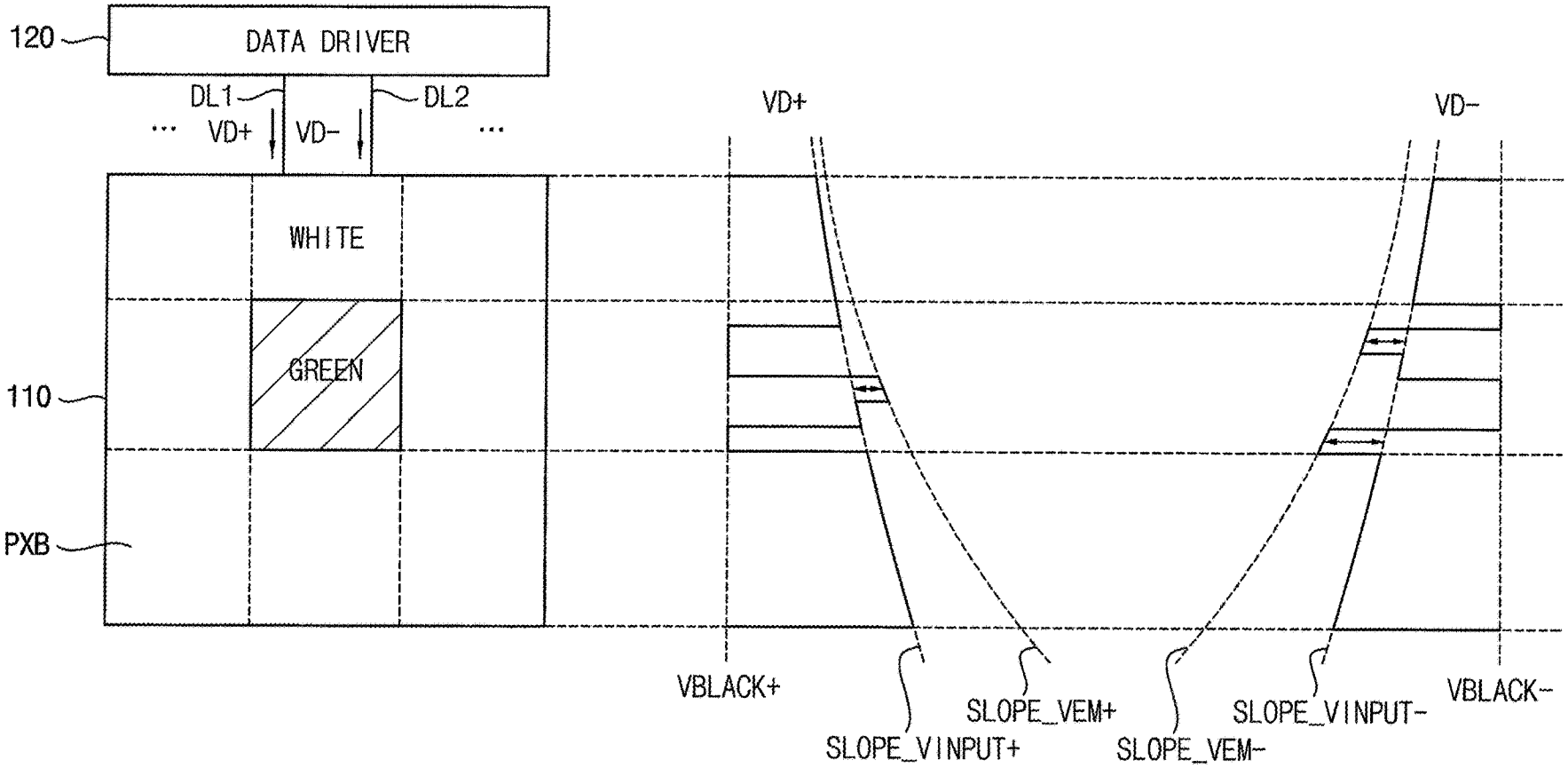
FIG. 6 is a diagram for describing an exemplary embodiment of emphasis voltages added to data voltages when a green single color image is displayed in one pixel block in a display device.

FIG. 6 is a diagram for describing an exemplary embodiment of emphasis voltages added to data voltages when a green single color image is displayed in one pixel block in a display device.

Referring to FIGS. 1 and 6, in some exemplary embodiments, an image determiner 150 may divide a display panel 110 into a plurality of pixel blocks PXB, and may determine whether input image data IDAT represent a single/mixed color image on a pixel block PXB basis. A data compensator 160 may perform, on the pixel block PXB basis, an operation increasing the input image data IDAT by a gray level increment corresponding to an emphasis voltage. In an exemplary embodiment, as illustrated in FIG. 6, the data compensator 160 may not perform the operation increasing the input image data IDAT by the gray level increment on the pixel block PXB in which the single/mixed color image is not displayed, and may perform the operation increasing the input image data IDAT by the gray level increment on the pixel block PXB in which the single/mixed color image is displayed, for example.

Figure 7:
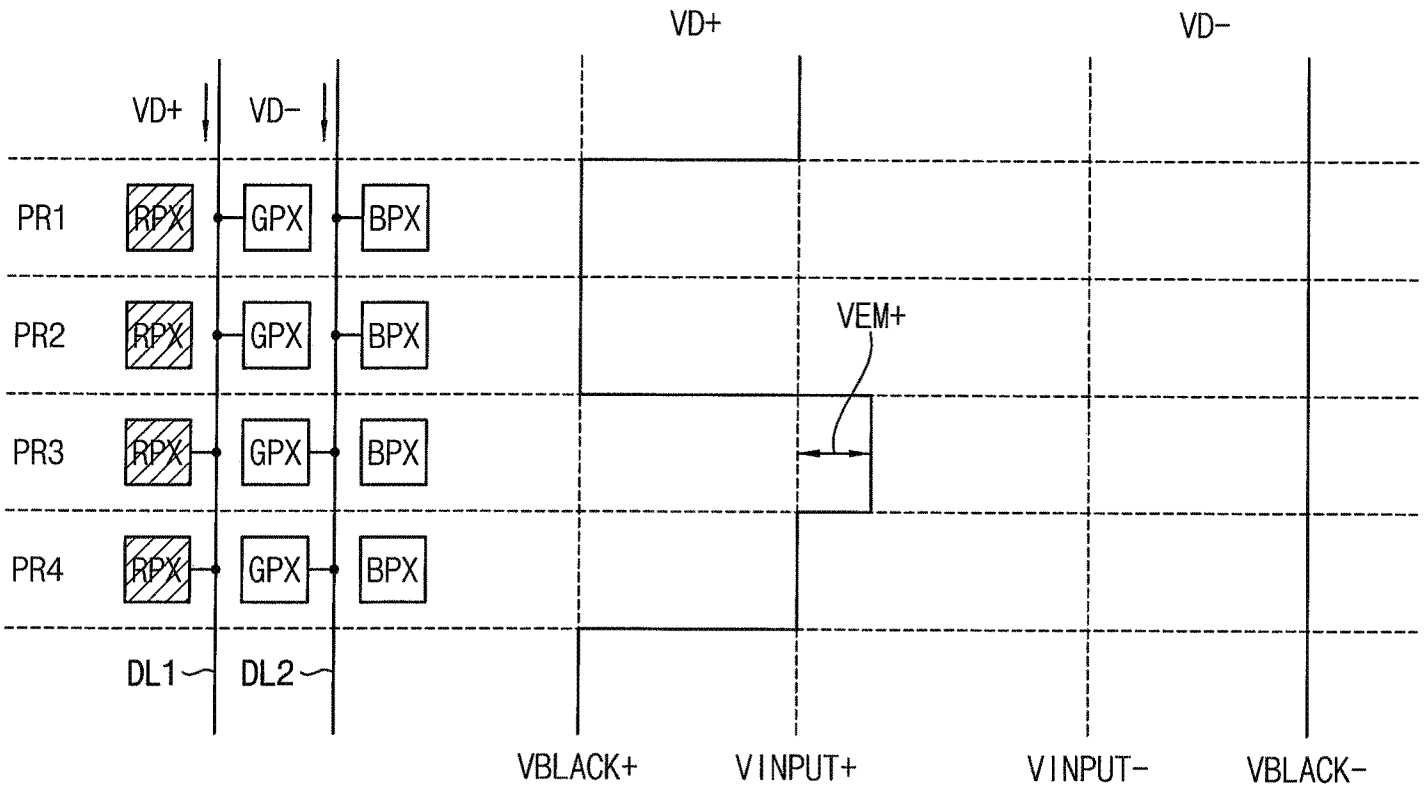
FIG. 7 is a diagram for describing data voltages applied to first and second data lines when a red single color image is displayed in at least a portion of a display panel.
Figure 8:
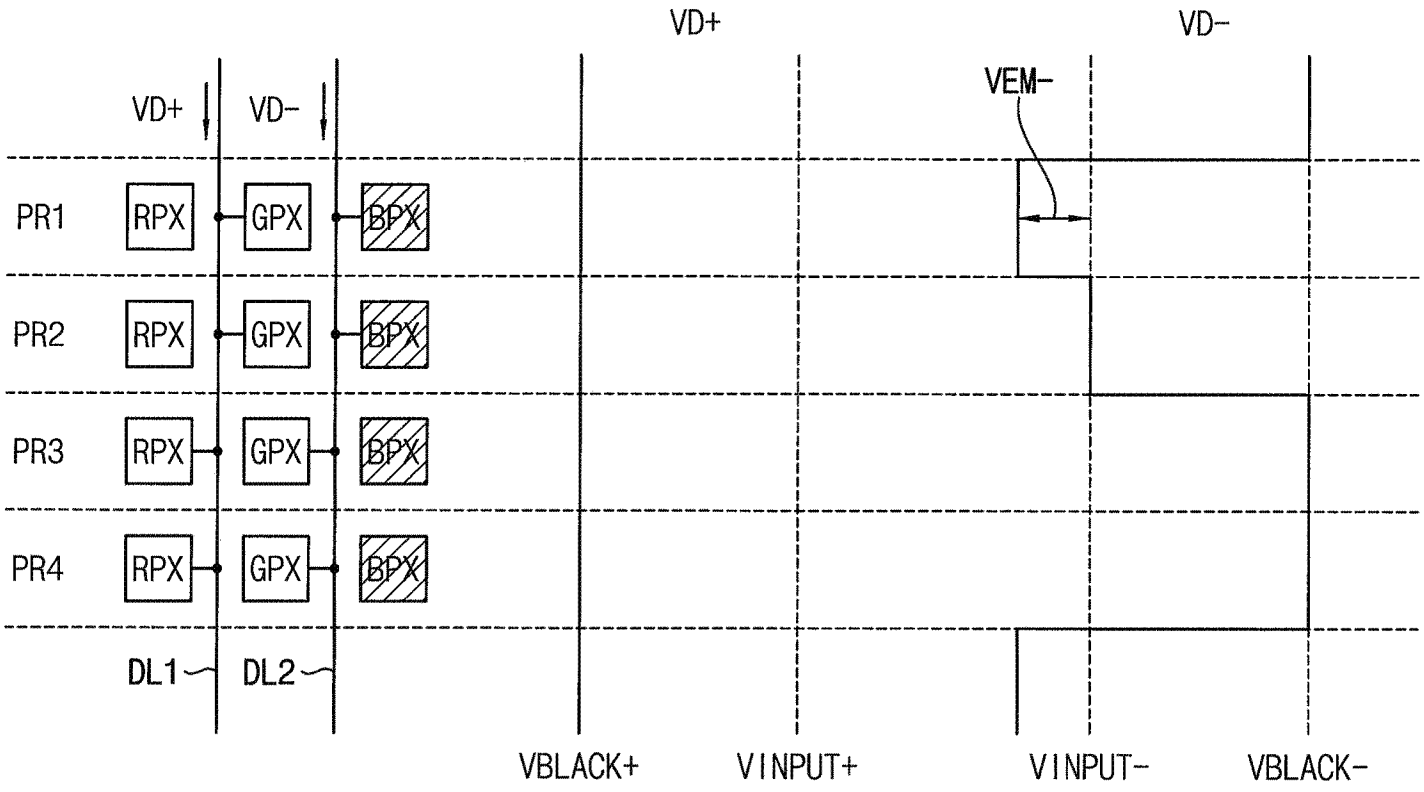
FIG. 8 is a diagram for describing data voltages applied to first and second data lines when a blue single color image is displayed in at least a portion of a display panel.

FIG. 7 is a diagram for describing data voltages applied to first and second data lines when a red single color image is displayed in at least a portion of a display panel, and FIG. 8 is a diagram for describing data voltages applied to first and second data lines when a blue single color image is displayed in at least a portion of a display panel.

Referring to FIGS. 1 and 7, when a single color image having a red color is displayed in at least a portion of a display panel 110 corresponding to first through third pixel columns PC1 through PC3 and first through fourth pixel rows PR1 through PR4, for example, a data driver 120 may apply a first polarity data voltage VD+ to which a first emphasis voltage VEM+ is added to a first data line DL1 in the third pixel row PR3. Further, the data driver 120 may apply a first polarity black data voltage VBLACK+ to the first data line DL1 in the first and second pixel rows PR1 and PR2, and may apply the first polarity data voltage VD+ to which the first emphasis voltage VEM+ is not added to the first data line DL1 in the fourth pixel row PR4. Further, the data driver 120 may apply a second polarity black data voltage VBLACK− to a second data line DL2 in the first through fourth pixel rows PR1 through PR4.

Further, Referring to FIGS. 1 and 8, when a single color image having a blue color is displayed in at least the portion of the display panel 110, for example, the data driver 120 may apply a second polarity data voltage VD− to which a second emphasis voltage VEM− is added to the second data line DL2 in the first pixel row PR1. Further, the data driver 120 may apply the second polarity data voltage VD− to which the second emphasis voltage VEM− is not added to the second data line DL2 in the second pixel row PR2, and may apply the second polarity black data voltage VBLACK− to the second data line DL2 in the third and fourth pixel rows PR3 and PR4. Further, the data driver 120 may apply the first polarity black data voltage VBLACK+ to the first data line DL1 in the first through fourth pixel rows PR1 through PR4.

Figure 9:
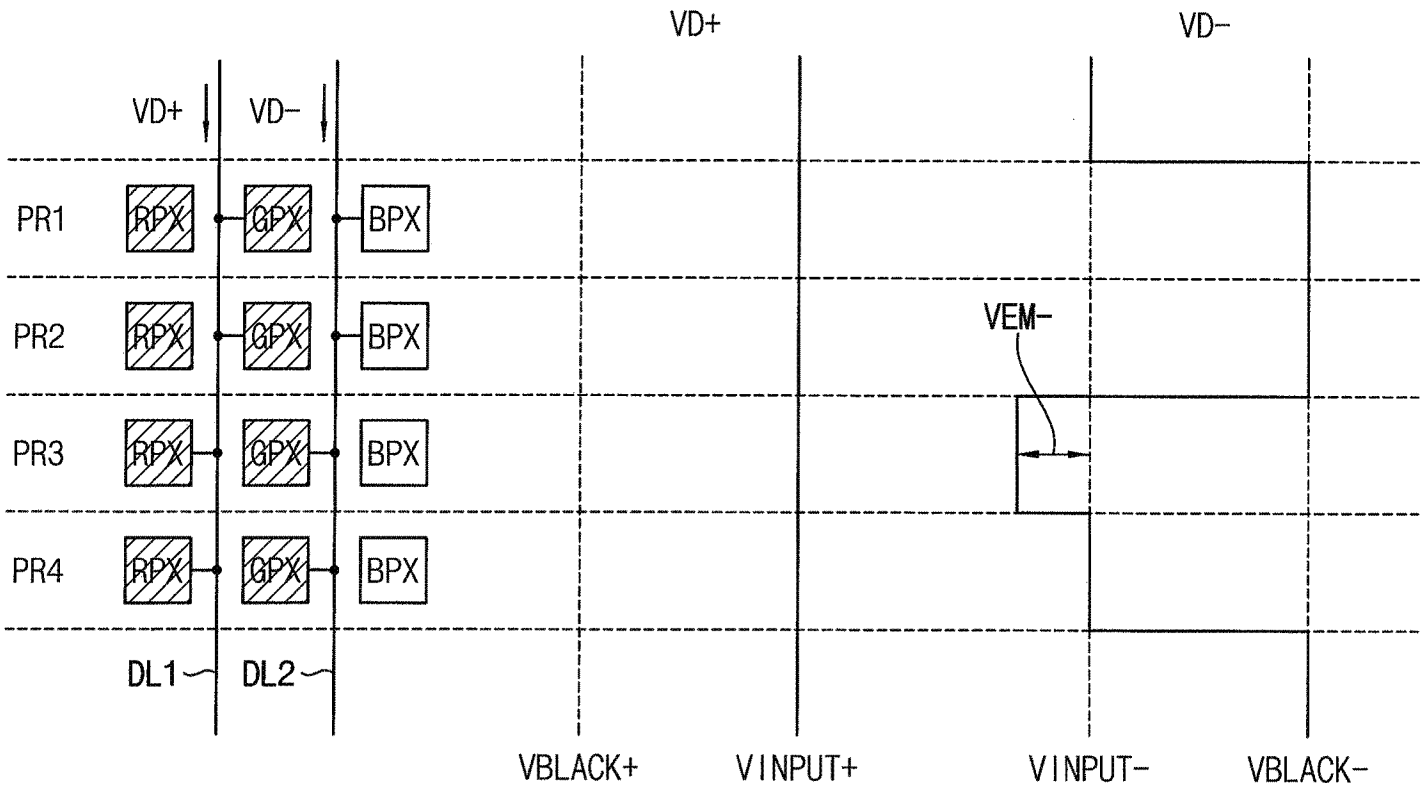
FIG. 9 is a diagram for describing data voltages applied to first and second data lines when a red and green mixed color image is displayed in at least a portion of a display panel.
Figure 10:
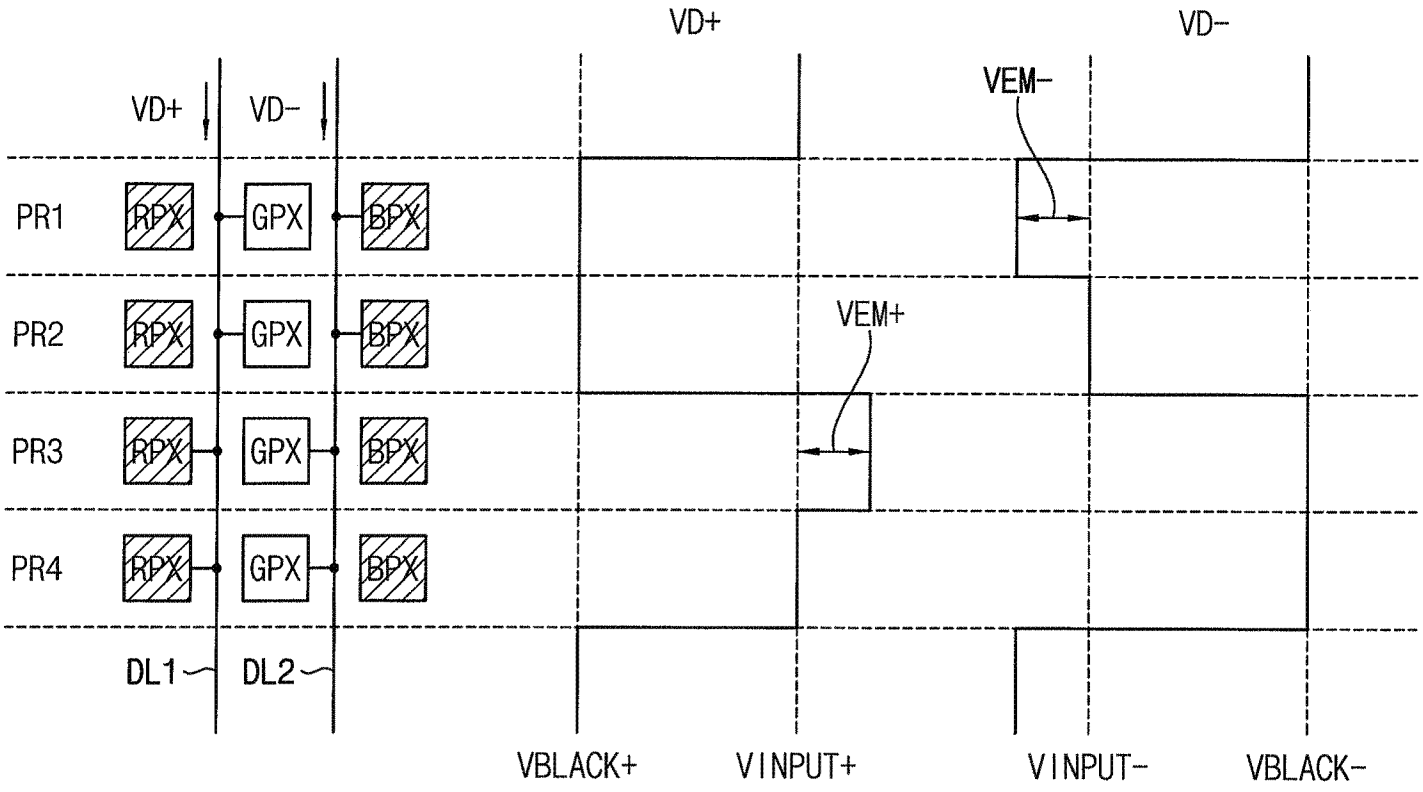
FIG. 10 is a diagram for describing data voltages applied to first and second data lines when a red and blue mixed color image is displayed in at least a portion of a display panel.
Figure 11:
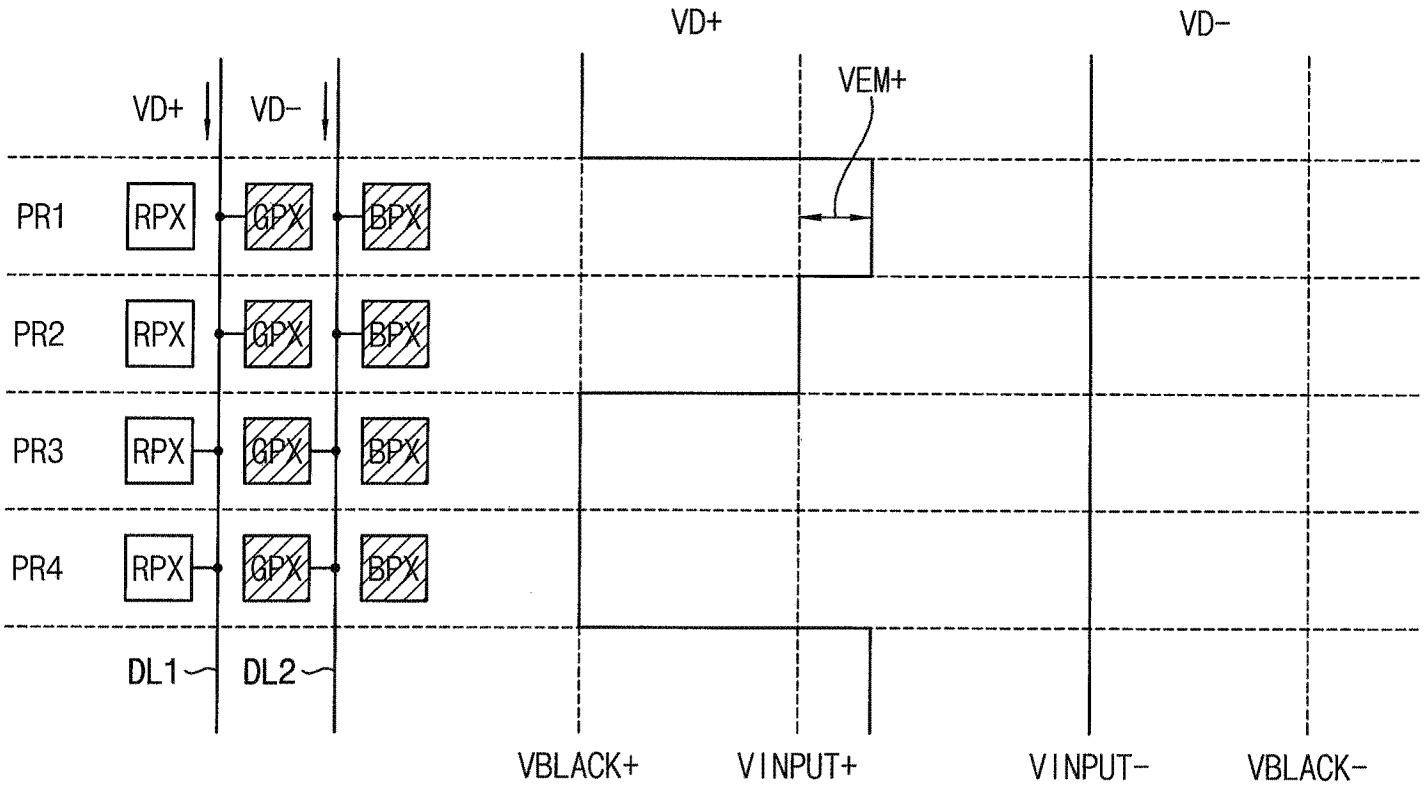
FIG. 11 is a diagram for describing data voltages applied to first and second data lines when a green and blue mixed color image is displayed in at least a portion of a display panel.

FIG. 9 is a diagram for describing data voltages applied to first and second data lines when a red and green mixed color image is displayed in at least a portion of a display panel, FIG. 10 is a diagram for describing data voltages applied to first and second data lines when a red and blue mixed color image is displayed in at least a portion of a display panel, and FIG. 11 is a diagram for describing data voltages applied to first and second data lines when a green and blue mixed color image is displayed in at least a portion of a display panel.

Referring to FIGS. 1 and 9, when a mixed color image having a red color and a green color is displayed in at least a portion of a display panel 110 corresponding to first through third pixel columns PC1 through PC3 and first through fourth pixel rows PR1 through PR4, for example, a data driver 120 may apply a second polarity data voltage VD− to which a second emphasis voltage VEM− is added to a second data line DL2 in the third pixel row PR3. Further, the data driver 120 may apply a second polarity black data voltage VBLACK− to the second data line DL2 in the first and second pixel rows PR1 and PR2, and may apply the second polarity data voltage VD− to which the second emphasis voltage VEM− is not added to the second data line DL2 in the fourth pixel row PR4. Further, the data driver 120 may apply a first polarity data voltage VD+ to which a first emphasis voltage VEM+ is not added to a first data line DL1 in the first through fourth pixel rows PR1 through PR4.

Further, referring to FIGS. 1 and 10, when a mixed color image having a red color and a blue color is displayed in at least the portion of the display panel 110, for example, the data driver 120 may apply the second polarity data voltage VD− to which the second emphasis voltage VEM− is added to the second data line DL2 in the first pixel row PR1, and may apply the first polarity data voltage VD+ to which the first emphasis voltage VEM+ is added to the first data line DL1 in the third pixel row PR3. Further, the data driver 120 may apply the second polarity data voltage VD− to which the second emphasis voltage VEM− is not added to the second data line DL2 in the second pixel row PR2, and may apply the second polarity black data voltage VBLACK− to the second data line DL2 in the third and fourth pixel rows PR3 and PR4. Further, the data driver 120 may apply the first polarity black data voltage VBLACK+ to the first data line DL1 in the first and second pixel rows PR1 and PR2, and may apply the first polarity data voltage VD+ to which the first emphasis voltage VEM+ is not added to the first data line DL1 in the fourth pixel row PR4.

Further, referring to FIGS. 1 and 11, when a mixed color image having a green color and a blue color is displayed in at least the portion of a display panel 110, for example, the data driver 120 may apply the first polarity data voltage VD+ to which the first emphasis voltage VEM+ is added to the first data line DL1 in the first pixel row PR1. Further, the data driver 120 may apply the first polarity data voltage VD+ to which the first emphasis voltage VEM+ is not added to the first data line DL1 in the second pixel row PR2, and may apply the first polarity black data voltage VBLACK+ to the first data line DL1 in the third and fourth pixel rows PR3 and PR4. Further, the data driver 120 may apply the second polarity data voltage VD− to which the second emphasis voltage VEM− is not added to the second data line DL2 in the first through fourth pixel rows PR1 through PR4.

Figure 12:
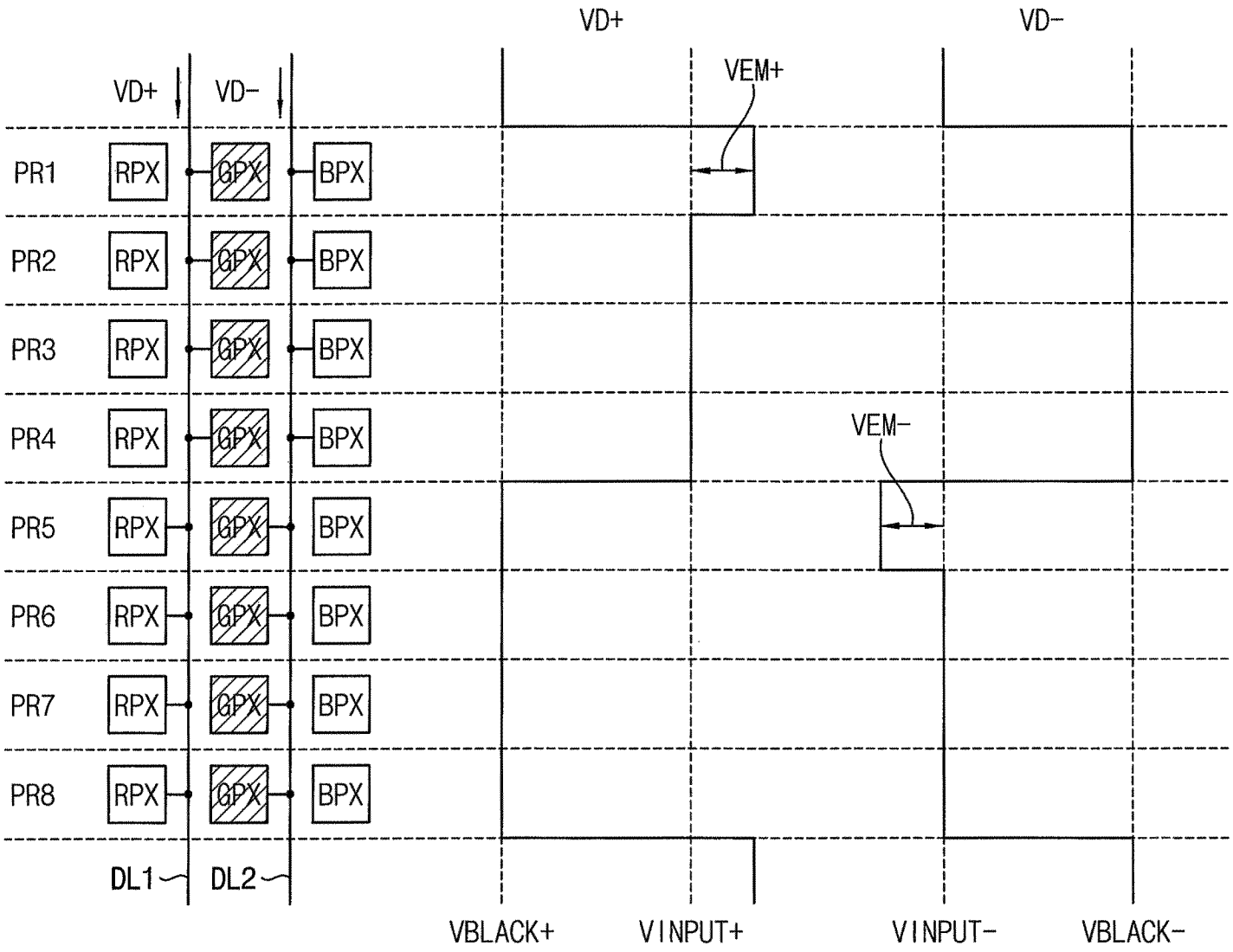
FIG. 12 is a diagram for describing data voltages applied to first and second data lines when a green single color image is displayed in at least a portion of a display panel in a display device where each data line is connected to one or the other of two adjacent pixel columns alternately per four pixel rows.

FIG. 12 is a diagram for describing data voltages applied to first and second data lines when a green single color image is displayed in at least a portion of a display panel in a display device where each data line is connected to one or the other of two adjacent pixel columns alternately per four pixel rows.

Referring to FIGS. 1 and 12, in some exemplary embodiments, a display panel 110 may have a 4-dot alternating structure where each data line (e.g., DL1) is connected to one or the other of two adjacent pixel columns (e.g., PC1 and PC2) alternately per four pixel (or dot) rows. In an exemplary embodiment, a first data line DL1 disposed between a first pixel column PC1 and a second pixel column PC2 may be connected to green pixels GPX of the second pixel column PC2 in first through fourth pixel rows PR1 through PR4, and may be connected to red pixels RPX of the first pixel column PC1 in fifth through eighth pixel rows PR5 through PR8, for example. Further, a second data line DL2 disposed between the second pixel column PC2 and a third pixel column PC3 may be connected to blue pixels BPX of the third pixel column PC3 in the first through fourth pixel rows PR1 through PR4, and may be connected to the green pixels GPX of the second pixel column PC2 in the fifth through eighth pixel rows PR5 through PR8.

In this case, when a single/mixed color image where at least one of three colors (e.g., a red color, a green color and a blue color) does not exist is displayed, the display device 100 according to exemplary embodiments may apply a data voltage VD+ and VD− to which an emphasis voltage VEM+ and VEM− is added to each data line DL1 and DL2 in a first pixel row (e.g., PR1 or PR5) among consecutive four pixel rows (e.g., PR1 through PR4 or PR5 through PR8) where each data line DL1 and DL2 is connected to the same pixel column, thereby preventing a horizontal line defect.

Figure 13:
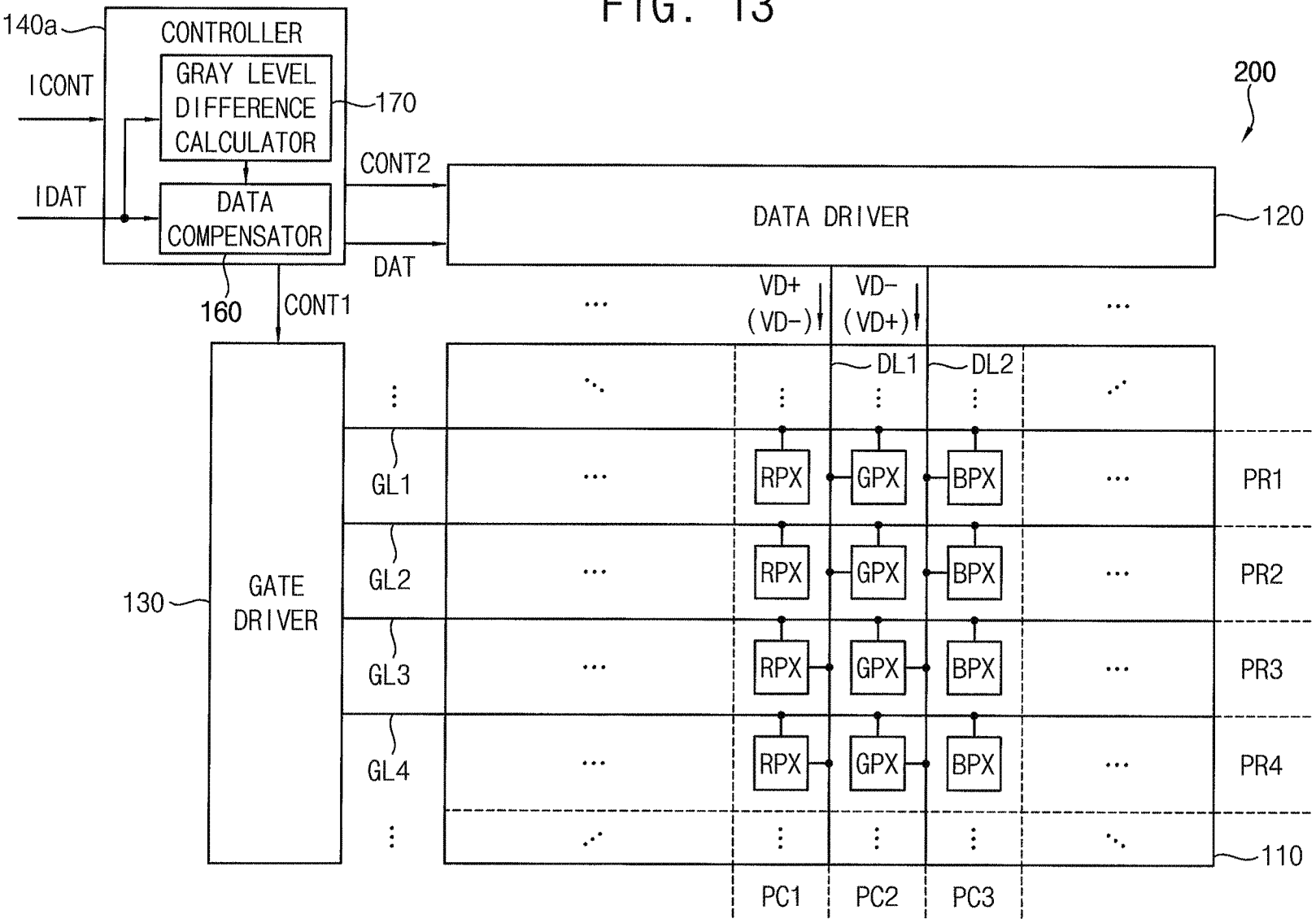
FIG. 13 is a block diagram illustrating an exemplary embodiment of a display device.

FIG. 13 is a block diagram illustrating an exemplary embodiment of a display device.

A display device 200 of FIG. 13 may have similar configurations and operations to a display device 100 of FIG. 1, except that a controller 140*a* may include a gray level difference calculator 170 instead of an image determiner 150 in FIG. 1.

Referring to FIG. 13, when a current pixel column (e.g., PC2) to which each data line (e.g., DL2) is connected in a current pixel row (e.g., PR3) is different from a previous pixel column (e.g., PC3) to which the each data line (e.g., DL2) is connected in a previous pixel row (e.g., PR2), and input image data IDAT for a current pixel (e.g., GPX) in the current pixel row (e.g., PR3) and the current pixel column (e.g., PC2) is greater, by more than a predetermined gray level difference, than the input image data IDAT for a previous pixel (e.g., BPX) in the previous pixel row (e.g., PR2) and the previous pixel column (e.g., PC3), a data driver 120 of the display device 200 may apply a data voltage to which an emphasis voltage is added (e.g., a positive data voltage VD+ to which a positive emphasis voltage is added or a negative data voltage VD− to which a negative emphasis voltage is added) to the current pixel (e.g., GPX).

To perform the aforementioned operation by the data driver 120, the controller 140*a* may compare the input image data IDAT for the current pixel (e.g., GPX) with the input image data IDAT for the previous pixel (e.g., BPX) in the current pixel row (e.g., PR3) where the current pixel column (e.g., PC2) to which the each data line (e.g., DL2) is connected is different from the previous pixel column (e.g., PC3) to which the each data line (e.g., DL2) is connected in the previous pixel row (e.g., PR2), and may generate compensated image data DAT by increasing the input image data IDAT for the current pixel (e.g., GPX) by a gray level increment corresponding to the positive emphasis voltage or the negative emphasis voltage when the input image data IDAT for the current pixel (e.g., GPX) is greater, by more than the predetermined gray level difference, than the input image data IDAT for the previous pixel (e.g., BPX). In some exemplary embodiments, the controller 140*a* may include the gray level difference calculator 170 and a data compensator 160.

The gray level difference calculator 170 may calculate a gray level difference by subtracting a gray level of the input image data IDAT for the previous pixel (e.g., BPX) from a gray level of the input image data IDAT for the current pixel (e.g., GPX) in the current pixel row (e.g., PR3) where the current pixel column (e.g., PC2) to which the each data line (e.g., DL2) is connected is different from the previous pixel column (e.g., PC3) to which the each data line (e.g., DL2) is connected in the previous pixel row (e.g., PR2). The data compensator 160 may increase the input image data IDAT for the current pixel (e.g., GPX) by the gray level increment when the calculated gray level difference is greater than the predetermined gray level difference.

In some exemplary embodiments, the gray level increment may be determined based on at least one of a position of the current pixel (e.g., GPX), a gray level of the input image data IDAT for the current pixel (e.g., GPX), and the gray level difference between the input image data IDAT for the current pixel (e.g., GPX) and the input image data IDAT for the previous pixel (e.g., BPX). In an exemplary embodiment, the gray level increment may increase as a distance from the data driver 120 to the current pixel (e.g., GPX) increases, for example. Further, the gray level increment may be determined such that a ratio of the gray level increment to the gray level of the input image data IDAT decreases as the gray level of the input image data IDAT increases. In addition, the gray level increment may increase as the gray level difference between the input image data IDAT for the current pixel (e.g., GPX) and the input image data IDAT for the previous pixel (e.g., BPX) increases.

Figure 14:
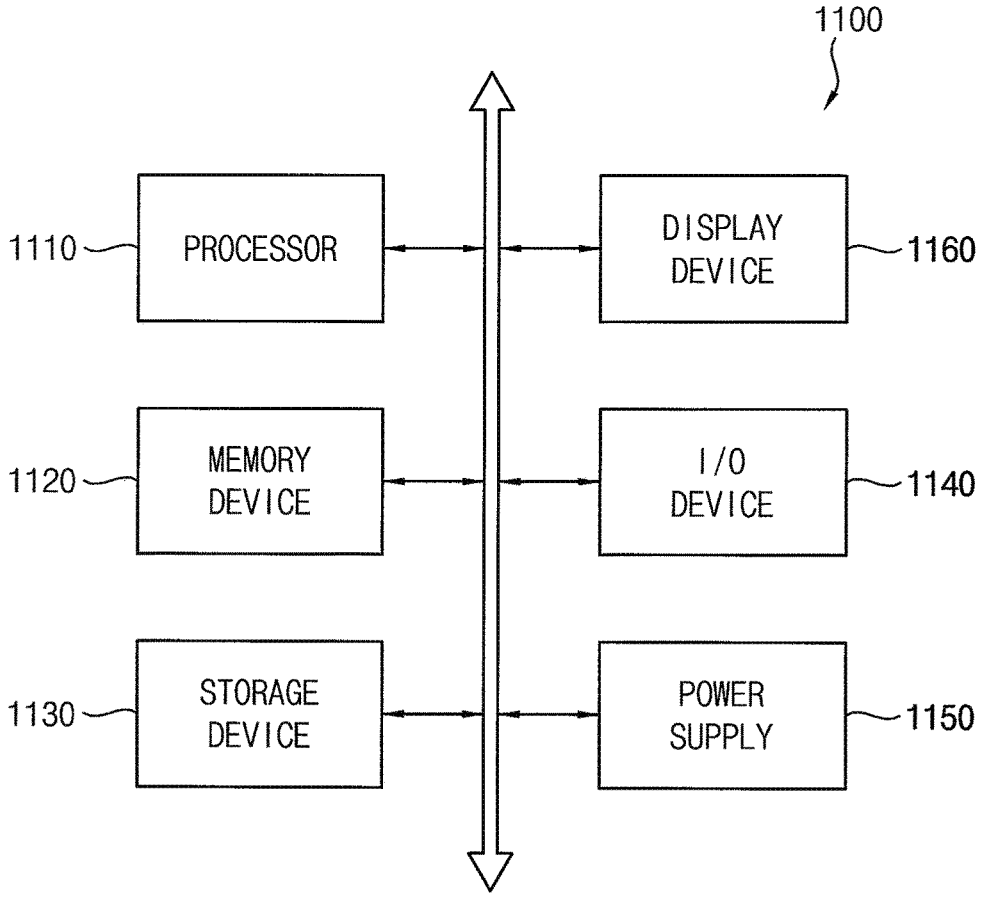
FIG. 14 is a block diagram illustrating an exemplary embodiment of an electronic device including a display device.

FIG. 14 is a block diagram illustrating an exemplary embodiment of an electronic device including a display device.

Referring to FIG. 14, an electronic device 1100 may include a processor 1110, a memory device 1120, a storage device 1130, an input/output ("I/O") device 1140, a power supply 1150, and a display device 1160. In an exemplary embodiment, the electronic device 1100 may further include a plurality of ports for communicating a video card, a sound card, a memory card, a universal serial bus ("USB") device, other electric devices, etc., for example.

The processor 1110 may perform various computing functions or tasks. In an exemplary embodiment, the processor 1110 may be an application processor ("AP"), a micro processor, a central processing unit ("CPU"), etc., for example. The processor 1110 may be coupled to other components via an address bus, a control bus, a data bus, etc. Further, in some exemplary embodiments, the processor 1110 may be further coupled to an extended bus such as a peripheral component interconnection ("PCI") bus, for example.

The memory device 1120 may store data for operations of the electronic device 1100. In an exemplary embodiment, the memory device 1120 may include at least one non-volatile memory device such as an erasable programmable read-only memory ("EPROM") device, an electrically erasable programmable read-only memory ("EEPROM") device, a flash memory device, a phase change random access memory ("PRAM") device, a resistance random access memory ("RRAM") device, a nano floating gate memory ("NFGM") device, a polymer random access memory ("PoRAM") device, a magnetic random access memory ("MRAM") device, a ferroelectric random access memory ("FRAM") device, etc., and/or at least one volatile memory device such as a dynamic random access memory ("DRAM") device, a static random access memory ("SRAM") device, a mobile dynamic random access memory (mobile DRAM) device, etc., for example.

In an exemplary embodiment, the storage device 1130 may be a solid state drive ("SSD") device, a hard disk drive ("HDD") device, a CD-ROM device, etc., for example. In an exemplary embodiment, the I/O device 1140 may be an input device such as a keyboard, a keypad, a mouse, a touch screen, etc., and an output device such as a printer, a speaker, etc., for example. The power supply 1150 may supply power for operations of the electronic device 1100. The display device 1160 may be coupled to other components via the buses or other communication links.

The display device 1160 may have an N-dot alternating structure where each of a plurality of data lines is connected to one or the other of two adjacent pixel columns alternately per N pixel rows, where N is an integer greater than 1, and may provide alternately a positive data voltage or a negative data voltage to the plurality of data lines, thereby performing an N-dot inversion method while reducing power consumption. Further, when a single/mixed color image where at least one of three colors (e.g., a red color, a green color and a blue color) does not exist is displayed, or when, with respect to each data line, a gray level in a current pixel row is greater, by more than a predetermined gray level difference, than a gray level in a previous pixel row, the display device 1160 may apply a data voltage to which an emphasis voltage is added in a first pixel row among the N pixel rows, thereby preventing a horizontal line defect.

In exemplary embodiments, the electronic device 1100 may be any electronic device including the display device 1160, such as a digital television, a three dimensional ("3D") television, a cellular phone, a smart phone, a tablet computer, a wearable device, a personal computer ("PC"), a home appliance, a laptop computer, a personal digital assistant ("PDA"), a portable multimedia player ("PMP"), a digital camera, a music player, a portable game console, a navigation system, etc., for example.

The foregoing is illustrative of exemplary embodiments and is not to be construed as limiting thereof. Although a few exemplary embodiments have been described, those skilled in the art will readily appreciate that many modifications are possible in the exemplary embodiments without materially departing from the novel teachings and advantages of the invention. Accordingly, all such modifications are intended to be included within the scope of the invention as defined in the claims. Therefore, it is to be understood that the foregoing is illustrative of various exemplary embodiments and is not to be construed as limited to the specific exemplary embodiments disclosed, and that modifications to the disclosed exemplary embodiments, as well as other exemplary embodiments, are intended to be included within the scope of the appended claims.

What is claimed is:

1. A display device comprising:

a display panel including first color pixels in a first pixel column, second color pixels in a second pixel column adjacent to the first pixel column, third color pixels in a third pixel column adjacent to the second pixel column, a first data line connected to the second color pixels in first through N-th pixel rows and connected to the first color pixels in (N+1)-th through 2N-th pixel rows, and a second data line connected to the third color pixels in the first through N-th pixel rows and connected to the second color pixels in the (N+1)-th through 2N-th pixel rows, where N is an integer greater than 1; and a data driver which applies a first polarity data voltage to the first data line, and applies a second polarity data voltage to the second data line, wherein, when a single color image having a color of the second color pixels is displayed in at least a portion of the display panel corresponding to the first through third pixel columns and the first through 2N-th pixel rows, the data driver applies the first polarity data voltage to which a first emphasis voltage is added to the first data line in the first pixel row, and applies the second polarity data voltage to which a second emphasis voltage is added to the second data line in the (N+1)-th pixel row, and wherein, when the single color image having the color of the second color pixels is displayed in at least the portion of the display panel, the data driver applies the first polarity data voltage to which the first emphasis voltage is not added to the first data line in the second through N-th pixel rows, and applies the second polarity data voltage to which the second emphasis voltage is not added to the second data line in the (N+2)-th through 2N-th pixel rows.

2. The display device of claim 1, wherein, when the single color image having the color of the second color pixels is displayed in at least the portion of the display panel, the data driver applies, as the second polarity data voltage, a second polarity black data voltage to the second data line in the first through N-th pixel rows, and applies, as the first polarity data voltage, a first polarity black data voltage to the first data line in the (N+1)-th through 2N-th pixel rows.

3. The display device of claim 1, wherein, in a first frame, the first polarity data voltage is a positive data voltage, the second polarity data voltage is a negative data voltage, the first emphasis voltage is a positive emphasis voltage, and the second emphasis voltage is a negative emphasis voltage, and wherein, in a second frame subsequent to the first frame, the first polarity data voltage is a negative data voltage, the second polarity data voltage is a positive data voltage, the first emphasis voltage is a negative emphasis voltage, and the second emphasis voltage is a positive emphasis voltage.

4. The display device of claim 1, wherein, when a single color image having a color of the first color pixels is displayed in at least the portion of the display panel, the data driver applies the first polarity data voltage to which the first emphasis voltage is added to the first data line in the (N+1)-th pixel row.

5. The display device of claim 1, wherein, when a single color image having a color of the third color pixels is displayed in at least the portion of the display panel, the data driver applies the second polarity data voltage to which the second emphasis voltage is added to the second data line in the first pixel row.

6. The display device of claim 1, wherein, when a mixed color image having a color of the first color pixels and the color of the second color pixels is displayed in at least the portion of the display panel, the data driver applies the second polarity data voltage to which the second emphasis voltage is added to the second data line in the (N+1)-th pixel row.

7. The display device of claim 1, wherein, when a mixed color image having a color of the first color pixels and a color of the third color pixels is displayed in at least the portion of the display panel, the data driver applies the second polarity data voltage to which the second emphasis voltage is added to the second data line in the first pixel row, and applies the first polarity data voltage to which the first emphasis voltage is added to the first data line in the (N+1)-th pixel row.

8. The display device of claim 1, wherein, when a mixed color image having the color of the second color pixels and a color of the third color pixels is displayed in at least the portion of the display panel, the data driver applies the first polarity data voltage to which the first emphasis voltage is added to the first data line in the first pixel row.

9. A display device comprising:

a display panel including first color pixels in a first pixel column, second color pixels in a second pixel column adjacent to the first pixel column, third color pixels in a third pixel column adjacent to the second pixel column, a first data line connected to the second color pixels in first through N-th pixel rows and connected to the first color pixels in (N+1)-th through 2N-th pixel rows, and a second data line connected to the third color pixels in the first through N-th pixel rows and connected to the second color pixels in the (N+1)-th through 2N-th pixel rows, where N is an integer greater than 1, and a data driver which applies a first polarity data voltage to the first data line, and applies a second polarity data voltage to the second data line, wherein, when a single color image having a color of the second color pixels is displayed in at least a portion of the display panel corresponding to the first through third pixel columns and the first through 2N-th pixel rows, the data driver applies the first polarity data voltage to which a first emphasis voltage is added to the first data line in the first pixel row, and applies the second polarity data voltage to which a second emphasis voltage is added to the second data line in the (N+1)-th pixel row, and wherein the display device further comprises:

a controller which receives input image data, and generates compensated image data by increasing a portion of the input image data for the first pixel row and the (N+1)-th pixel row where a pixel column to which each of the first and second data lines is connected is changed by a gray level increment corresponding to the first emphasis voltage or the second emphasis voltage when the input image data represent a single color image having one color of three colors of the first through third color pixels or a mixed color image having two colors of the three colors of the first through third color pixels.

10. The display device of claim 9, wherein the controller includes:

an image determiner which determines whether the input image data represent the single color image or the mixed color image; and a data compensator which increases the input image data for a current pixel row and a current pixel column by the gray level increment when the input image data represent the single color image or the mixed color image, the current pixel column to which each of the first and second data lines is connected in the current pixel row is different from a previous pixel column to which each of the first and second data lines is connected in a previous pixel row, the input image data for the previous pixel column represent a gray level of 0, and the input image data for the current pixel column represent a gray level other than 0.

11. The display device of claim 10, wherein, when the input image data for the first color pixels represent the gray level of 0 and the input image data for the second color pixels represent the gray level other than 0, the data compensator increases the input image data for the second color pixels in the first pixel row and the second pixel column by the gray level increment, wherein, when the input image data for the first color pixels represent the gray level other than 0 and the input image data for the second color pixels represent the gray level of 0, the data compensator increases the input image data for the first color pixels in the (N+1)-th pixel row and the first pixel column by the gray level increment, wherein, when the input image data for the second color pixels represent the gray level of 0 and the input image data for the third color pixels represent the gray level other than 0, the data compensator increases the input image data for the third color pixels in the first pixel row and the third pixel column by the gray level increment, and wherein, when the input image data for the second color pixels represent the gray level other than 0 and the input image data for the third color pixels represent the gray level of 0, the data compensator increases the input image data for the second color pixels in the (N+1)-th pixel row and the second pixel column by the gray level increment.

12. The display device of claim 9, wherein the gray level increment is determined based on at least one of a position of a pixel to which the first emphasis voltage or the second emphasis voltage is applied and a gray level of the input image data for the pixel to which the first emphasis voltage or the second emphasis voltage is applied.

13. The display device of claim 12, wherein the gray level increment increases as a distance from the data driver to the pixel to which the first emphasis voltage or the second emphasis voltage is applied increases.

14. The display device of claim 12, wherein the gray level increment is determined such that a ratio of the gray level increment to the gray level of the input image data decreases as the gray level of the input image data increases.

15. A display device comprising:

a display panel including a plurality of pixels arranged in a matrix having a plurality of pixel rows and a plurality of pixel columns, and a plurality of data lines extending in a direction of the plurality of pixel columns; and a data driver which alternately provides a positive data voltage or a negative data voltage to the plurality of data lines, wherein each data line of the plurality of data lines is disposed between two adjacent pixel columns of the plurality of pixel columns, and is connected to one or a remaining one of the two adjacent pixel columns alternately per N pixel rows of the plurality of pixel rows, where N is an integer greater than 1, wherein, when a current pixel column to which the each data line is connected in a current pixel row is different from a previous pixel column to which the each data line is connected in a previous pixel row, and input image data for a current pixel in the current pixel row and the current pixel column is greater, by more than a predetermined gray level difference, than the input image data for a previous pixel in the previous pixel row and the previous pixel column, the data driver applies the positive data voltage to which a positive emphasis voltage is added or the negative data voltage to which a negative emphasis voltage is added to the current pixel, and wherein the display device further comprises:

a controller which receives the input image data, compares the input image data for the current pixel with the input image data for the previous pixel in the current pixel row where the current pixel column to which the each data line is connected is different from the previous pixel column to which the each data line is connected in the previous pixel row, and generates compensated image data by increasing the input image data for the current pixel by a gray level increment corresponding to the positive emphasis voltage or the negative emphasis voltage when the input image data for the current pixel is greater, by more than the predetermined gray level difference, than the input image data for the previous pixel.

16. The display device of claim 15, wherein the controller includes:

a gray level difference calculator which calculates a gray level difference by subtracting a gray level of the input image data for the previous pixel from a gray level of the input image data for the current pixel in the current pixel row where the current pixel column to which the each data line is connected is different from the previous pixel column to which the each data line is connected in the previous pixel row; and a data compensator which increases the input image data for the current pixel by the gray level increment when a calculated gray level difference is greater than the predetermined gray level difference.

17. The display device of claim 15, wherein the gray level increment is determined based on at least one of a position of the current pixel, a gray level of the input image data for the current pixel, and a gray level difference between the input image data for the current pixel and the input image data for the previous pixel.

18. The display device of claim 17, wherein the gray level increment increases as a distance from the data driver to the current pixel increases.

* * * * *